US005683177A

United States Patent [19]

Hoferichter et al.

[11] Patent Number: 5,683,177

[45] Date of Patent: Nov. 4, 1997

[54] CYLINDRICAL HIGH-CAPACITY TRANSPORT MIXER FOR BULK MATERIAL AND LIQUIDS

[75] Inventors: Frank Hoferichter; Frank Herrmann; Holger Dietrich, all of Chemnitz, Germany

[73] Assignee: Imk Ingenieurkontor fuer Maschinenkonstruktion GmbH, Frankenberg, Germany

[21] Appl. No.: 602,805

[22] PCT Filed: Sep. 15, 1994

[86] PCT No.: PCT/DE94/01094

§ 371 Date: Feb. 26, 1996

§ 102(e) Date: Feb. 26, 1996

[87] PCT Pub. No.: WO95/09074

PCT Pub. Date: Apr. 6, 1995

[30] Foreign Application Priority Data

Sep. 29, 1993 [DE] Germany ..... 43 33 087.8
Sep. 12, 1994 [DE] Germany ..... 9414733 U

[51] Int. Cl.[6] ..... B01F 9/02; B28C 5/42; B28C 7/16

[52] U.S. Cl. ..... 366/44; 366/59; 366/227; 366/233

[58] Field of Search ..... 366/41, 44, 53, 366/54, 56–59, 62–63, 187, 188, 225–229, 233

[56] References Cited

U.S. PATENT DOCUMENTS

| | | | |
|---|---|---|---|
| Re. 32,043 | 12/1985 | Routson . | |
| 1,657,762 | 1/1928 | Paris . | |
| 1,781,965 | 11/1930 | Ball . | |
| 1,872,624 | 8/1932 | Eggert | 366/44 |
| 1,928,380 | 9/1933 | Jaeger et al. | 366/44 X |
| 1,991,297 | 2/1935 | Schluter . | |
| 2,038,158 | 4/1936 | Barrymore . | |
| 2,048,657 | 7/1936 | Jaeger . | |
| 2,270,628 | 1/1942 | Fitzgerald | 366/59 |
| 3,567,190 | 3/1971 | Moran . | |
| 4,506,983 | 3/1985 | Marr | 366/44 |

FOREIGN PATENT DOCUMENTS

| | | | |
|---|---|---|---|
| 479643 | 1/1948 | Belgium . | |
| 0240594 | 10/1987 | European Pat. Off. . | |
| 1083414 | 1/1955 | France . | |
| 1550856 | 12/1968 | France . | |
| 408092 | 1/1925 | Germany . | |
| 581116 | 7/1933 | Germany . | |
| 660491 | 5/1938 | Germany . | |
| 3610095 | 10/1987 | Germany . | |
| 291794 | 12/1931 | Italy | 366/44 |
| 17936 | 7/1913 | United Kingdom . | |

*Primary Examiner*—Charles E. Cooley
*Attorney, Agent, or Firm*—Jordan and Hamburg

[57] ABSTRACT

A transporter-mixer for bulk-material/liquid mixtures has a cylindrical transport container mounted on a support frame with its longitudinal axis approximately horizontal and a controllable container-drive unit whose direction is reversible as a function of the angle of rotation. Fitted on the transport container periphery is a closable loading hatch which opens into the transport container. Mounted on the transport container's inside wall is a mixing screw and at a rear end of the container is an annular discharge channel with an inwards-facing discharge port. The mean height of the mixing screw is, at the most, 15% of the container diameter and a curved, enclosed guide channel of essentially constant cross-section connects the annular discharge channel and a central discharge port.

17 Claims, 4 Drawing Sheets

CYLINDRICAL HIGH-CAPACITY TRANSPORT MIXER FOR BULK MATERIAL AND LIQUIDS

BACKGROUND OF THE INVENTION

The present invention relates to a transport mixer for bulk-material or solid/liquid mixtures, and more particularly, to a transport mixer having a cylindrical transport silo, mounted on a frame, with an almost horizontal axis and a controllable drive for the transport silo, which can be reversed depending upon an angle of rotation, the transport silo having a feed opening on its periphery, which can be closed, a conveyor spiral on an interior wall of the transport silo and a circular discharge channel with a discharge opening directed towards the interior of the transport silo and which is located at a rear wall of the transport silo.

Transport mixers having a cylindrical transport silo are known through, among others, the U.S. Pat. No. 2,038,158. The transport mixer described in this patent has a cylindrical transport silo, the longitudinal axis of which is mounted horizontally on the frame of a vehicle. The transport silo has a drive motor for axial rotation of the cylindrical transport silo which is supported by a respective bearing on the frame. The transport mixer has a locking feed opening, approximately in the middle of the horizontal axis of its cylinder wall, which is to be opened when it is on the upper side of the transport silo. A mixer spiral is positioned on the cylindrical interior wall of the transport silo for conveying a viscous concrete in the transport silo axially, thus mixing it. On an end wall at a rear end of the transport silo, an opening is positioned close to the periphery of the transport silo, through which the mixture is conveyed in a circular discharge channel. The discharge channel spans over an angle of 240°. A second channel is located in its interior. Should the rear end of the discharge channel lie below the surface of the viscous mixture, the mixture in the discharge channel is first conveyed into this second channel. Both channels are followed by a spiral-shaped wall, which, on further rotation to the back, conveys the mixture, flowing out from the rear of the channels, to the central discharge opening. This discharge opening is open to the rear of the transport silo.

The above arrangement has many decisive disadvantages and, therefore, this concept has not received any attention for more than 60 years and, in general, pear-shaped transport silos with an inclined rotation axis have been used. In detail, the disadvantages of the design according the patent U.S. Pat. No. 2,038,158 are the following: the feed opening on the periphery of the cylinder could not be closed safely, the energy generated by the vehicle was not sufficient to ensure consistency of the mixture during transport, and it was not possible to ensure fast and continuous discharging of the transport silo while at the same time avoiding overflowing during transport.

Cleaning of such a transport silo has also posed considerable problems. The quantity of water, required for cleaning the cylindrical transport silo with horizontal positioning of the axis is too high in terms of economy.

For the above reasons, transport silos with an inclined axis have been used. With the growing demand for the fast transport of large quantities of light concrete, concrete flooring material or other viscous materials which can be hardened, it has become necessary to increase the volume of the transport mixers. In this respect, the inclined transport mixers have reached their limit of application. The load of the transport mixer cannot be distributed uniformly on the axles of the transport vehicle so that individual axles would, by far, exceed the load capacity of the streets.

SUMMARY OF THE INVENTION

The object of the present invention is to construct a transport mixer with a horizontal, cylindrical transport silo allowing large quantities of mixtures to be distributed in the transport silo, complete sealing of the transport silo during transport, preservation of a consistency of the mixture during transport at low energy expenditure, fast and almost continuous discharging of the transport silo, and cleaning with a low quantity of water during return to the place of charging.

In accordance with these and other objects of the invention, there is provided a transport mixer for bulk-solid/liquid mixtures, comprising: a cylindrical transport silo mounted on a frame having an almost horizontal axis; a controllable drive for the transport silo, which can be reversed depending upon an angle of rotation; the transport silo having a locking feed opening on its periphery; a conveyor spiral on the interior of a cylinder wall of the transport silo; a circular discharge channel, with a discharge opening directed towards an interior of the transport silo, located in a rear end wall of the transport silo and along a portion of a periphery thereof; a feed opening provided with a lid pivotable to an interior of the transport silo; the conveyor spiral having mean vane height of a maximum of 15 percent of the transport silo diameter; and an arc-shaped closed guide channel with a cross section substantially equal to that of the circular discharge channel provided between the circular discharge channel on the periphery of the transport silo and a central discharge opening.

The feed opening is in the middle of the transport silo to ensure fast inflow and distribution of the mixture in the transport silo. It is not necessary for the conveyer spiral to be operated in the distribution process. The position and arrangement of the lid guarantees complete sealing of the transport silo during transport.

Due to the reduced height of the conveyor spiral, the consistency of the mixture is maintained with low energy even at a high charging level. The design of the discharge channel guarantees that large quantities of the mixture can be discharged almost continuously in a very short time.

The discharge channel has a simple design, it enables on the one hand—the unobstructed flow of the mixture and —on the other hand —an unobstructed flow of the cleaning water into the transport silo. Even at a high charging level and an extreme inclination of the transport silo, it is almost impossible that any part of the mixture can escape through the discharge opening. The present invention thus enables conveyance of large quantities of bulk materials with short charging and discharging periods. A capacity of up to 15 $m^3$ can be achieved with this type of design. The capacity of the inclined, pear-shaped transport silos is limited to 12 $m^3$.

According to a feature of the invention, it is further provided that the lid of the feed opening is pivotable to the interior of the transport and is held in a closed position by a spring and is opened with a controllable opening mechanism disposed on stationary positioned charging hopper above the transport silo, whereby it is possible to position the lid in a location where, during the opening and charging procedure, operation of rotation control mechanisms for distribution purposes is largely avoided.

The present invention further includes the lid being disposed upon a pivot arm and the opening mechanism having a controlled pivotable stop which is adjusted via a hydraulic piston relative to the pivot arm dependent upon the angle of rotation of transport silo by the use of simple, proven and robust control elements, which guarantee a high level of operability.

According to a still further feature of the invention, there is provided a device for positioning the controlled pivotal stop in at three positions, a closed position, a tripping position and an open position to enable repeated opening and closing of the lid and, at the same time, to enable removal of residues of the mixture from the lid seal.

The stationary hopper being above the feed opening and disposed on supports pivotally mounted on a frame such that the supports encircle the transport silo ensures minimal losses during the filling process of the bulk material. The supports additionally secure the transport mixer on the frame of the vehicle.

The design of the conveyor spiral guarantees the consistency of the mixture during transport. In addition, it ensures the low-residual-level transfer of the mixture to the discharge side and cleaning with a low quantity of water.

The present invention also includes the above embodiments wherein, in the alternative, various implementations of features of the above embodiments are incorporated. For example a vane height of the conveyor spiral increases from a front end of the transport silo to the rear end of the transport spiral. Preferably, the vane height varies continuously, or in steps, from about 2% to about 20% which provides advantages concerning maintenance of the mixture consistency without increased energy being required for rotating the transport mixer.

A further feature of the present invention includes the discharge channel being positioned on an outside of the end wall of the transport silo making it is possible to access the discharge channel from all sides in order to remove residues of the mixture which might have hardened on the interior of the discharge channel.

According to yet another feature of the present invention the discharge channel is circular about an outside periphery of the transport silo and communicates with the interior of the transport silo through the discharge opening whereat the conveyor spiral terminates, and the arc shaped guide channel is disposed on an outside of the transport silo to connect the discharge channel with the central discharge opening. The design of the discharge channel offers continuously good sliding conditions for the mixture.

Still another feature of the present invention includes an attachment device for attaching a water supply pipe to a discharge hopper, connected to the central discharge opening, prior to opening the discharge channel for cleaning of the transport silo.

Yet another feature of the present invention includes an outside perimeter of the end wall of the transport silo having a circumferential ring which rides upon bearings seated on the frame of the transport mixer to provide a stabilizing effect at the end wall of the transport silo.

A still further feature of the present invention includes a collection container disposed beneath the discharge hopper and connected to an efficient vane pump for thick materials. With a pump of this type, the mixture can-be conveyed in a very short time over large distances—even at heights of 30–40 m—with only little energy.

BRIEF DESCRIPTION OF THE DRAWINGS

The present invention is described in detail on the basis of one design example detailed in the individual drawings which show the following.

Figure 1:
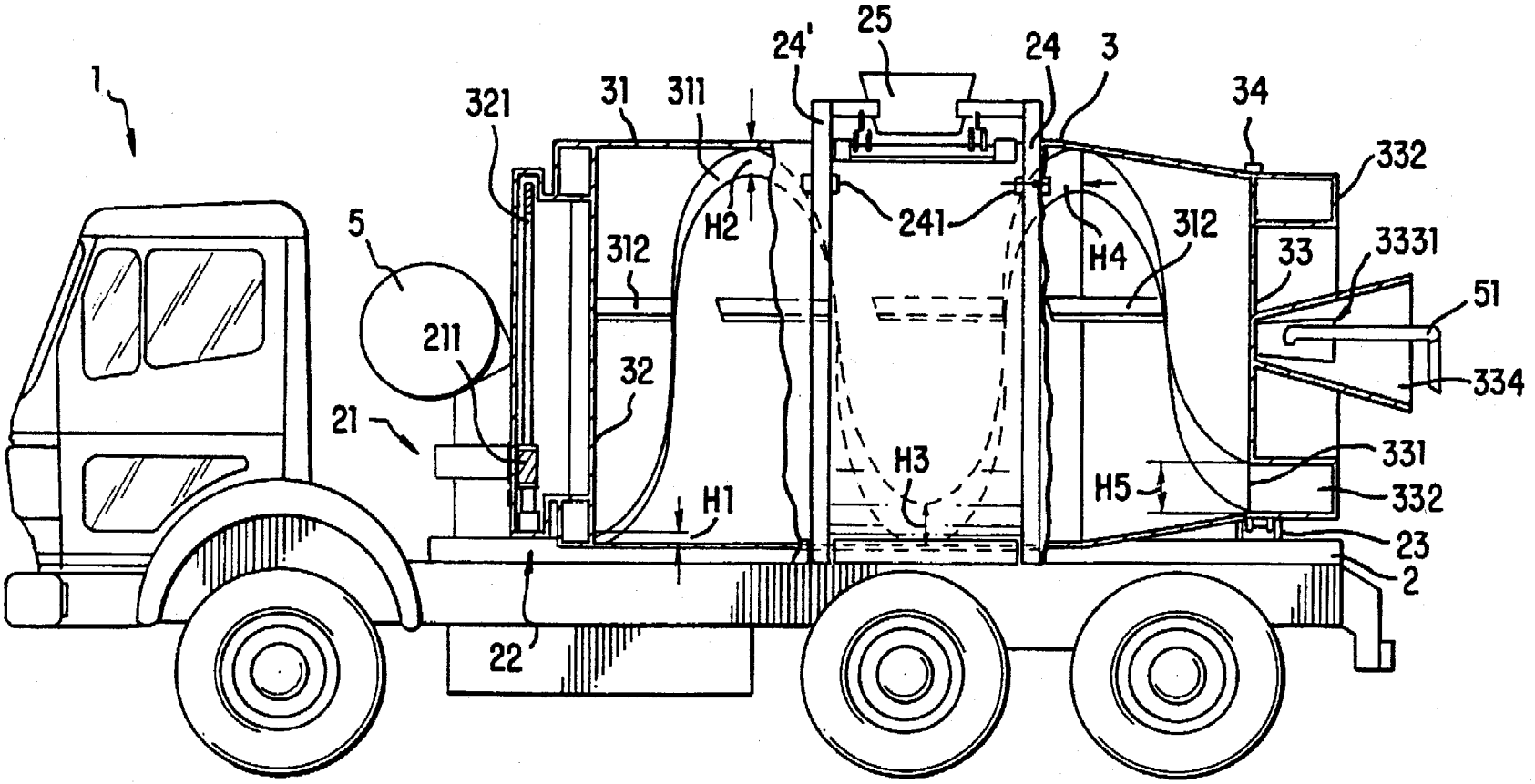
FIG. 1 shows a side view of an embodiment of a transport mixer of the present invention on a vehicle, partially in cross sections.
Figure 4:
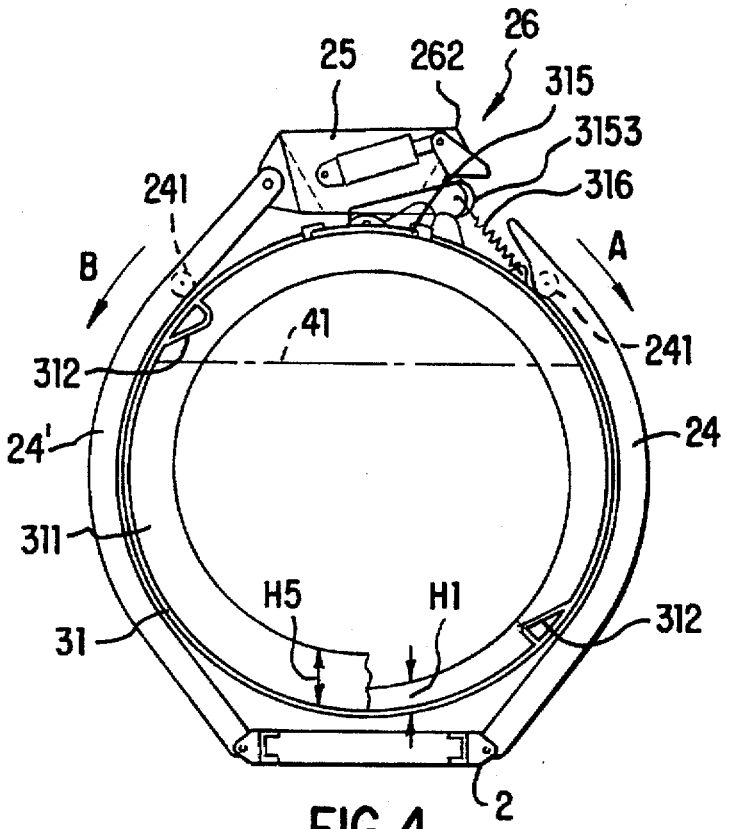
Figure 5:
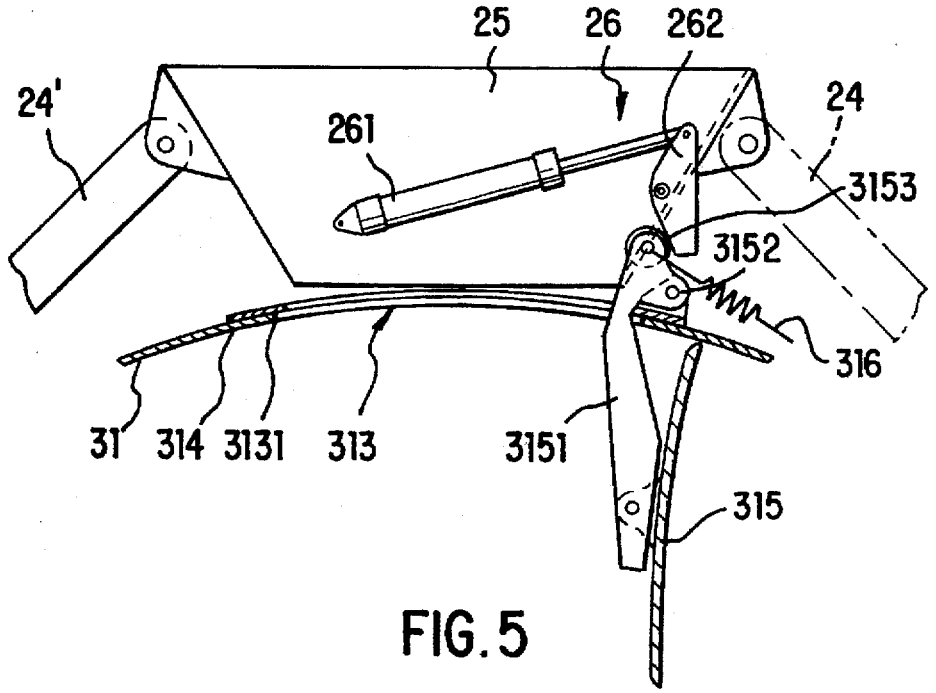
Figure 6:
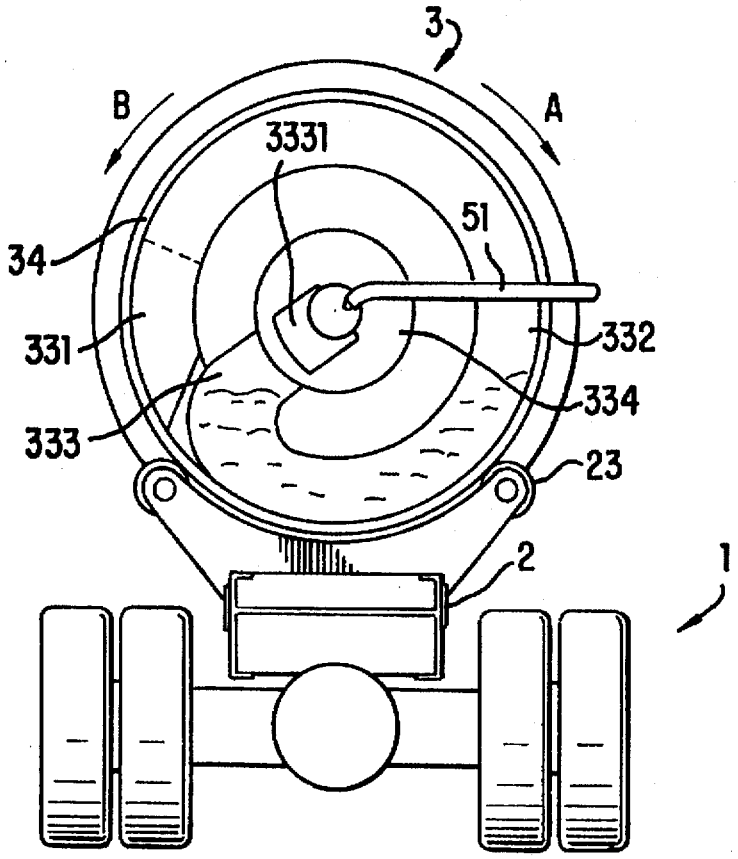
Figure 7:
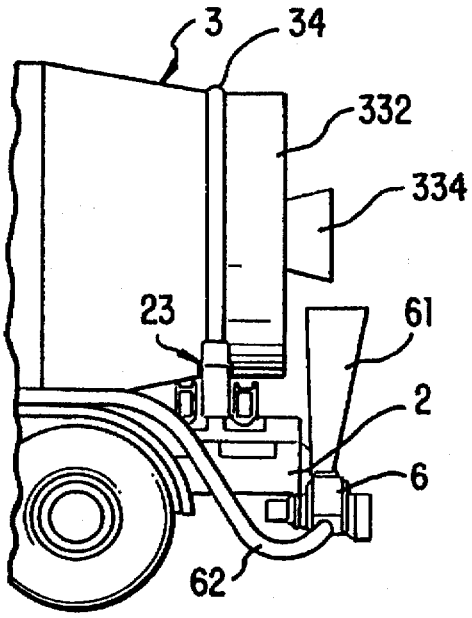

FIGS. *2a–2d* show cross-sectional views of four successive positions of a discharge and conveyor channel the embodiment of FIG. 1, when the transport silo is rotated in the mixing direction;

FIGS. *3a–3d* show cross-sectional views of four successive positions of the discharge and conveyor channel the embodiment of FIG. 1, when the transport silo is rotated in the discharge direction;

FIG. 4 shows a longitudinal cross-sectional view of the transport silo of FIG. 1 at the position of a feed opening;

FIG. 5 shows an enlarged diagram of the feed opening of FIG. 4 with a control mechanism and charging hopper;

FIG. 6 shows a rear view of the vehicle with the transport mixer according to FIG. 1; and FIG. 7 shows partial side view of the rear of the vehicle with transport mixer of FIG. 1 having a vane pump.

DETAILED DESCRIPTION OF THE INVENTION

Referring to FIGS. 1, 4 and 5, a transport mixer has a cylindrical transport silo 3 mounted rotatably on a frame 2 of a vehicle 1. The axis of the transport silo 3 is arranged basically horizontally.

Rotation of the transport silo 3 is effected by a drive motor 21, which is not illustrated in detail, via respective gear elements 211, 321. The drive motor 21 is controlled in such a way that the transport silo 3 performs operational functions dependent on the respective angle and direction of rotation. A rotational speed of the drive motor 21 is preferably controllable within the normal range. The transport silo 3 is normally mounted on a pivot (not illustrated).

An additional supporting bearing 23 is provided in the area of discharge elements at a rear end of the transport silo 3 and interacts with a drive ring 34 on the periphery of the transport silo 3. Two pivotable supports 24, 24' are pivotally mounted on opposing sides of the frame 2 about a middle portion of the transport silo 3, embracing the outside of the transport silo 3 and supporting a hopper 25 at upper ends thereof. Supports 24, 24' have so-called grip rollers 241, which additionally secure the transport silo 3 on the frame 2.

A conveyor spiral 311 is mounted on an inner cylinder wall 31 of the transport silo 3 and has a varying vane height H1 . . . H5 which increases progressively, or in steps, from a front end wall 32 on the driving side of the transport silo 3 to a rear end wall 33 on the discharge side of the transport silo 3. The vane height H1 is at least 2% of the diameter of transport silo 3 and increases to approximately 20% at the rear end wall of the discharge side. Preferably, the mean vane height does not exceed 15% of the diameter of the transport silo 3. For better maintenance of the mixture consistency during transport using little energy, three mixing members 312 are arranged at the interior periphery of the transport silo 3.

Referring to FIGS. 4 and 5, for charging the solid/liquid mixture into the transport silo 3, a feed opening 313 is provided in the cylinder wall 31. During charging, the feed opening 313 is positioned on the upper side of the transport silo 3. It is positioned approximately in the middle of the transport silo 3 so that mixture 4 fed (shown in FIGS. *2a–3d*) distributes uniformly over the interior of the transport silo 3. In this way, the activation of the conveyor spiral 311 through the rotation of the transport silo 3 is avoided for charging procedures. The feed opening 313 is provided with a lid 315 configured for a tight closing fit with the transport silo 3. The lid 315 has a pivot arm 3151 pivotally disposed on a bearing 3152 mounted to the outer wall of the transport silo 3. The pivot arm 3151 also supports a roller 3153 which is adjusted by a controlled stop 262. The lid 315 is held in a closed position by a spring 316.

An opening mechanism 26 is provided on the hopper 25. The opening mechanism 26 has an adjusting piston 261 and a pivotable stop 262 which can have three different positions in relation to the circular path of roller 3153. In a first position, the stop 262 does not approach the region of the roller 3153 and the lid 315 remains closed. In a second position, a so-called trip position, roller 3153 is displaced only slightly and the lid 315 is opened for a short period and then returned to the closed position immediately afterwards through the action of spring 316. This procedure is necessary for removing mixture residues, through an impact effect, from a seal 3131 on a frame 314 of the feed opening 313 before final closing of the lid 315. In a third position of the stop 262, the feed opening 313 is completely opened with the lid 315 oriented in a vertical position, as shown in FIG. 5. The vertical position effects a resistance-free removal of mixture residues from the lid 315. During subsequent closing, a sufficiently tight sealing of the transport silo 3 is possible. Furthermore, the mass of the mixture 4 in the transport silo 3 additionally supports sealing.

At the rear end of the transport silo 3, the so-called discharge side, the transport silo 3 is closed by an end wall 33. The end wall 33 defines a discharge opening 331 through which the mixture 4 can flow into a discharge channel 332. The discharge channel 332 is arranged at the periphery of the transport silo 3 and disposed on the outside of the end wall 33. The discharge channel 332 extends over an angle greater than 220° and is concentric to the transport silo 3.

The end of the discharge channel 332, which is opposite to and communicates with the discharge opening 331, runs tangentially and arc-shaped into guide channel 333 which conveys mixture 4 into the plane of the rotational axis of the transport silo 3. The guide channel 333 has an opening 3331 which opens within walls of a discharge hopper 334. A water pipe 51, for introducing cleaning water, is connectable to the discharge hopper 334. Mixture 4 is conveyed by the conveyor spiral 311, rotating in the direction of rotation B shown in FIG. 3, into the area of the discharge opening 331. The mixture 4 is conveyed first to the discharge channel 332 and then to the outside via the guide channel 333 and hopper 334. By means of a chute or other suitable auxiliary aids, the concrete is conveyed to the place where it is to be worked.

Figure 2A:
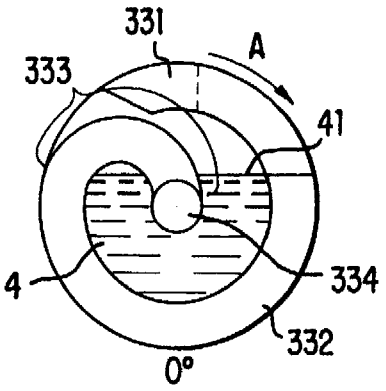
Figure 2B:
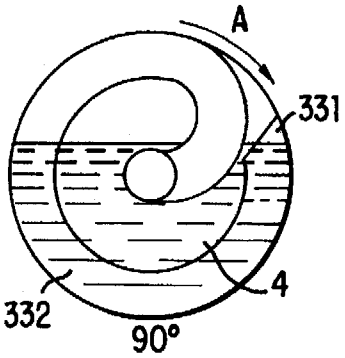
Figure 2C:
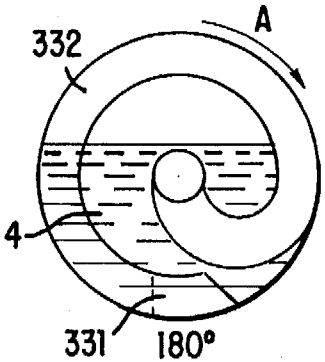
Figure 2D:
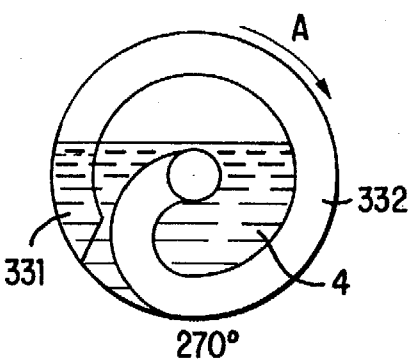
Figure 3A:
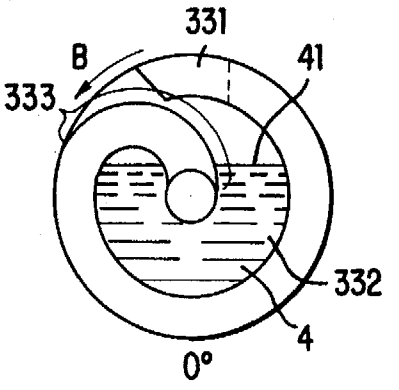
Figure 3B:
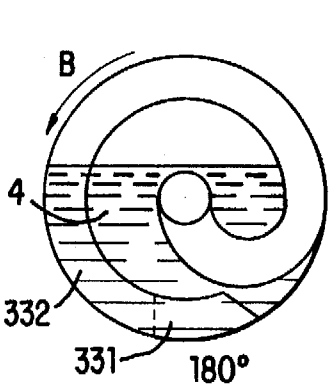
Figure 3C:
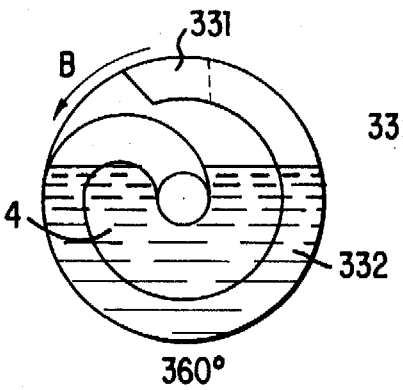
Figure 3D:
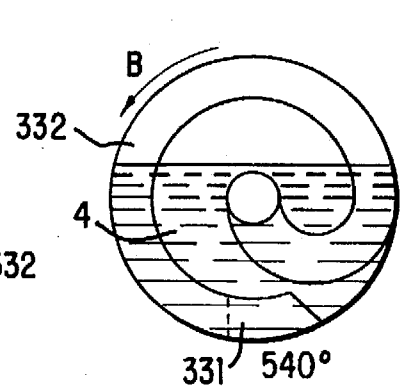

The mode of operation of the discharge device is shown in FIGS. 2*a*–2*d* and FIGS. 3*a*–3*d* by different successive positions with reference to one direction of rotation of the transport silo each and with further reference to FIG. 6. In FIGS. 2*a*–2*d*, the mode of operation has a direction of rotation A and serves for mixing the mixture 4 in the transport silo 3. Rotation of the conveyor spiral 331 in direction A conveys mixture 4 toward the front end wall 32. With the transport silo position at 0°, as shown in FIG. 2*a*, charging is carried out. At the 0° position, the feed opening 331 is positioned at the top side of the transport silo 3. During a rotation through 90° in direction A shown in FIG. 2*b*, the feed opening 331 immerses in mixture 4. Liquid mixture 4 can thus collect in the discharge channel 332. During this procedure, viscous mixtures will flow in the discharge channel 332 only slowly. If the discharge opening 331 comes out of mixture 4 (180° to approx. 300°), the discharge channel 332 is empty again. Overflowing of the transport silo 3 via the discharge channel 332 is almost impossible. If the discharge channel 332 is extended to 360°, by arranging it in a cylindrical, spiral-shaped manner, overflowing is virtually impossible.

When the transport mixer has reached its destination, the direction of rotation is changed to that of direction B, shown in FIGS. 3*a*–3*d*, for discharging. The discharge procedure is illustrated in FIGS. 3*a*–3*d* at four different angular positions. Initially, the discharge channel 332 is empty when oriented at the 0° position shown in FIG. 3*a*. As soon as the discharge opening 331 immerses in mixture 4 by rotation in direction B to a 180° position shown in FIG. 2*b*, the discharge channel 332 is filled. Mixture 4 in the discharge channel 332 reaches the same level as mixture 4 in the transport silo 3. When the guide channel 333, however, lowers into mixture 4 at positions ranging from that of 360°, shown in FIG. 3*c*, to that of 600°, mixture 4 flows through the force of gravity into the guide channel 333 and through the opening 3331 into the discharge hopper 334.

At a high filling level 41, discharge of the mixture 4 is carried out over an angle range of rotation which is considerably greater than 180°. Should discharging be terminated upon the first rotation, the discharge channel 332 will have been refilled with mixture 4 through its opening 331 and the mixture 4 flows to the discharge hopper 334 after a short break. In practice, the mixture can be discharged continually, and the discharge speed can be regulated optionally by adjusting the speed of the drive motor.

In conclusion, conveyance process for mixtures 4 with transport mixer described is carried out as follows. At a central mixing station, the bulk material, at first dry, is mixed with water shortly before charging. The ready mixture 4 is filled with high speed into nonrotating transport silo 3 through the open feed opening 331. The mixture 4 is distributed immediately throughout the transport silo 3 without additional aids being necessary for distribution in the transport silo 3. The lid 315 is finally closed tight after several slams (tripping). Mixture residues are as a result removed from seal 3131 and the lid 315 closes tightly.

Once charged with bulk materials, the transport silo 3 is rotated in direction A. Transport can then be started. Due to the low vane height H1 . . . H5 and mixing members 312, consistency of the mixture 4 during transport is maintained with little energy at a low speed of rotation in direction A.

On the building site, the direction of rotation of the transport silo 3 is changed to direction B for discharging. The discharge speed is determined by regulating the discharge speed of rotation B. During discharge of large quantities, it is necessary to fill these large quantities in the prepared formwork before the hardening process has started, i. e. in a very short period of time. This can be effected through the application of vane pumps, with which also thick materials—such as light concrete or concrete flooring material—can also be conveyed over large distances to extreme heights in a quick and reliable manner. For this purpose, referring to FIG. 7, a pump 6 of this type—with a relatively low mass—is directly connected to the transport mixer. For driving the vane pump 6, the motor of the vehicle or an independent motor can be used. A collecting container 61 at the suction channel of the vane pump 6 for the mixture discharged equalizes possible different conveyance capacities and serves as the customary intermediate storage. Tube 62 can be fastened to and carried on the transport vehicle. It will be handled by the crane provided on the building site.

What is claimed is:

1. A transport mixer for bulk-solid/liquid mixtures, which mounts on a frame of a vehicle, the transport mixer comprising:

a cylindrical transport silo means for rotatably mounting said cylindrical transport silo on said frame with a longitudinal axis of said cylindrical transport silo in a substantially horizontal orientation;

controllable drive means for rotating the cylindrical transport silo in first and second directions and fixing a rotational position of said cylindrical transport silo;

said cylindrical transport silo having a cylindrical wall defining a feed opening and a lid for closing said feed opening, said lid being pivotable into an interior of said cylindrical transport silo;

a conveyor spiral an interior wall of said cylindrical wall, said conveyor spiral having a mean vane height equal to a maximum of 15% of a diameter of said cylindrical transport silo;

said cylindrical transport silo having a rear end wall defining a discharge opening in a peripheral portion thereof;

a circular discharge channel disposed on an external periphery of said rear end wall with a first end communicating with said discharge opening; and an arc-shaped guide channel having a first end connected with a second end of said circular discharge channel and a second end defining a central discharge opening positioned on said longitudinal axis of said cylindrical transport silo.

2. A transport mixer, according to claim 1, further comprising:

said lid having a spring for biasing said lid in a closed position;

a charging hopper disposed above said feed opening; and controllable opening means on said charging hopper for opening said lid into said cylindrical transport silo when said feed opening is aligned beneath said charging hopper.

3. A transport mixer according to claim 2, wherein said charging hopper is mounted on said frame by first and second support members pivotally connected to said frame on opposing sides of said cylindrical transport silo such that said first and second support members and said charging hopper encircle said cylindrical transport silo and said first and second support members each have a grip roller for engaging said cylindrical transport silo.

4. A transport mixer, according to claim 1 wherein said lid has a pivot arm pivotally connecting said lid with said cylindrical transport silo and further comprising an opening means for opening said lid into said cylindrical transport silo, said opening means having a hydraulic piston means for engaging said pivot arm to open said lid.

5. A transport mixer, according to claim 4, wherein said opening means includes means for controlling said hydraulic piston means to selectively position said lid in three positions, a closed position, a tripping position and an open position.

6. A transport mixer, according to claim 1, wherein said conveyor spiral extends from a front end wall of said cylindrical transport silo to said rear end wall of said cylindrical transport silo and a vane height of said conveyor spiral increases from said front end wall to said rear end wall.

7. A transport mixer, according to claim 6, wherein said vane height of said conveyor spiral increases from approximately 2% of a diameter of transport silo to a maximum of 20% of said diameter.

8. A transport mixer, according claim 1, further comprising mixing members projecting from said cylindrical wall into the interior of said cylindrical transport silo.

9. A transport mixer, according to claim 1, wherein said circular discharge channel is on the outside of said rear end wall and said conveyor spiral is connected to said rear end wall of said cylindrical transport silo at said discharge opening.

10. A transport mixer, according to claim 1, wherein said arc-shaped guide channel has a spiral shape and is connected tangentially to said discharge channel and ends inside a discharge hopper arranged coaxially along said longitudinal axis of said cylindrical transport silo.

11. A transport mixer, according claim 10, further including means for connecting an end of a water pipe externally to said discharge hopper.

12. A transport mixer, according to claim 10, further comprising a vane pump mounted on said frame having a collecting container connected to a suction channel of said vane pump which is disposed below said discharge hopper.

13. A transport mixer, according claim 1, wherein said cylindrical transport silo has a drive ring on a circumferential periphery of a rear end of said cylindrical transport silo and said frame has supporting bearings for engaging said drive ring.

14. A transport mixer for bulk-solid/liquid mixtures, which mounts on a frame of a vehicle, the transport mixer comprising:

a cylindrical transport silo;

means for rotatably mounting said cylindrical transport silo on said frame with a longitudinal axis of said cylindrical transport silo in a substantially horizontal orientation;

controllable drive means for rotating the cylindrical transport silo in first and second directions and fixing a rotational position of said cylindrical transport silo;

said cylindrical transport silo having a cylindrical wall defining a feed opening and a lid for closing said feed opening;

a conveyor spiral on an interior wall of said cylindrical wall;

said cylindrical transport silo having a rear end wall defining a discharge opening in a peripheral portion thereof;

a discharge channel disposed on 220° or more of an external periphery of said rear end wall with a first end communicating with said discharge opening; and a guide channel having a first end connected with a second end of said discharge channel and a second end defining a central discharge opening positioned on said longitudinal axis of said cylindrical transport silo for carrying mixture from the discharge channel at said external periphery of said rear end wall to said central discharge opening.

15. A transport mixer according to claim 14 wherein said lid is pivotally mounted on said cylindrical wall to open into an interior of said cylindrical transport silo.

16. A transport mixer for bulk-solid/liquid mixtures, which mounts on a frame of a vehicle, the transport mixer comprising:

a cylindrical transport silo;

means for rotatably mounting said cylindrical transport silo on said frame with a longitudinal axis of said cylindrical transport silo in a substantially horizontal orientation;

controllable drive means for rotating the cylindrical transport silo in first and second directions and fixing a rotational position of said cylindrical transport silo;

said cylindrical transport silo having a cylindrical wall defining a feed opening and a lid for closing said feed opening, said lid being pivotable into an interior of said cylindrical transport silo;

bias means for biasing said lid in a closed position;

a conveyor spiral on an interior wall of said cylindrical wall;

said cylindrical transport silo having a rear end wall defining a discharge opening in a peripheral portion thereof; and an arcuate discharge chute means, disposed on 220° or more of an external side of said rear end wall with a first end communicating with said discharge opening, for transporting mixture from said discharge opening to a central discharge opening positioned on said longitudinal axis of said cylindrical transport silo.

17. A transport mixer according to claim 16 further comprising hydraulic piston means, disposed above said cylindrical transport silo, for opening said lid and support means for supporting said hydraulic piston means on said frame and above said cylindrical transport silo.

* * * * *